United States Patent [19]

Popp et al.

[11] 4,256,826

[45] Mar. 17, 1981

[54] BLEACH-FIX SHEETS

[75] Inventors: Gerhard Popp, Webster; Patrick H. Saturno; Keith H. Stephen, both of Rochester, all of N.Y.

[73] Assignee: Eastman Kodak Company, Rochester, N.Y.

[21] Appl. No.: 933,399

[22] Filed: Aug. 14, 1978

[51] Int. Cl.[3] ..... G03C 7/00; G03C 5/32

[52] U.S. Cl. ..... 430/213; 430/215; 430/223; 430/238; 430/242; 430/371; 430/376; 430/393; 430/451; 430/460; 430/461; 430/497

[58] Field of Search ..... 96/29 R, 29 D, 3, 48 R, 96/73, 76 R, 114, 60 BF

[56] References Cited

U.S. PATENT DOCUMENTS

| | | | |
|---|---|---|---|
| 3,041,952 | 7/1962 | Schreck | 96/50 R |
| 3,053,656 | 9/1962 | Corley | 96/61 M |
| 3,179,517 | 4/1965 | Tregillus et al. | 96/29 |
| 3,347,675 | 10/1967 | Henn et al. | 96/50 R |
| 3,414,411 | 12/1968 | Michel et al. | 96/53 |
| 3,712,818 | 1/1973 | Nittel et al. | 96/61 M |
| 3,832,179 | 8/1974 | Edens | 96/55 |
| 3,832,181 | 8/1974 | Dallon et al. | 96/111 |
| 3,832,199 | 8/1974 | Repsher et al. | 106/183 |
| 3,923,510 | 12/1975 | Staples | 96/3 |
| 3,954,473 | 5/1976 | Lambert | 96/60 BF |
| 4,088,486 | 5/1978 | Bissonette | 96/60 BF |
| 4,168,169 | 9/1979 | Humphlett et al. | 96/53 |

OTHER PUBLICATIONS

The Theory of the Photographic Process 4th Ed-.-James MacMillan, N.Y. ©1977 pp. 450–453.

*Primary Examiner*—J. Travis Brown
*Attorney, Agent, or Firm*—Arthur H. Rosenstein

[57] ABSTRACT

A bleach-fix sheet for use in color photographic processes comprises a support having thereon a bleaching agent, a fixing agent and a hardened hydrophilic binder. In a preferred embodiment, the bleach-fix sheet is useful to bleach and fix a retained image in a color image diffusion transfer unit.

33 Claims, No Drawings

BLEACH-FIX SHEETS

This invention relates to a bleach-fix sheet to be used in bleaching and fixing an element containing a silver image and a color-providing material so that the resulting element contains only colorant imagewise. The bleach-fix sheet contains a bleaching agent, a fixing agent and a hardened hydrophilic binder.

In the field of rapid access color photography which is directed to the transfer of a colorant imagewise from one layer or element to another receiving layer or element, the color image is provided by a process wherein the colorant or color former is released from a donor layer or element in imagewise fashion and transferred to a receiver layer or element. The image used is the color image in the receiving layer. The donor layer can either be removed by peeling or stripping or can be retained integrally with the imaged receiver.

Recently, some effort has gone into providing a useful image in photosensitive elements of image-transfer film units. Specifically, the imaging element, acting as the donor element, can comprise a support and one or more silver halide emulsion layers having associated therewith dye image-providing materials, and the receiver element can comprise a support containing a dye image-receiving layer. A silver halide developing agent is present in the unit. After the donor element is imagewise-exposed to light, it is brought into contact with a processing composition which causes the colorant or color former to diffuse either in the imaged or nonimaged areas from the donor to the receiver element. The donor element can now be used by peeling it from the receiving layer and bleaching the silver and fixing the remaining silver halide to leave only colorant or color formers in the imaged or nonimaged areas. Thus, the image used in the retained image in the donor layer or element.

A problem with the above and in instances where the final color image is produced in this initially light-sensitive element, is the need to remove the developed silver image and the residual silver halide. The method most commonly employed in the prior art is to treat the element in a solution containing a bleaching agent and a fixing agent subsequent to development and color-image formation. This necessitates an additional step to obtain the final dye image. This step also requires physical handling and rather intricate timing problems.

In the in-camera silver dye bleach process wherein a dye image is obtained by exposing imagewise, developing at a pH of 12 to 14 and reducing the pH to 3 and rendering the silver halide transparent and removing the silver and dye in the exposed areas, a dye bleach solution is generally used.

In Mowrey and Oftedahl U.S. patent application Ser. No. 662,403 filed Mar. 1, 1976, a photothermographic silver dye bleach process is described wherein the dye bleach process is carried out using an activator web to thermally produce the color image. The dry activator sheet is used to initiate a silver-dye bleach reaction.

In U.S. Pat. No. 3,414,411, a process is disclosed wherein silver images are produced in the presence of a bleachable dye followed by contact with a web which bleaches the dye in the presence of silver to produce a color image in the photosensitive element.

In both of the above processes, the web contains ingredients to initiate a silver-dye bleach reaction coated in vehicles such as gelatin, polyvinyl alcohol and the like. These webs, however, have not been found to be useful in bleach-fixing the retained image containing elements described above.

U.S. Pat. No. 3,923,510 of Staples, issued Dec. 2, 1975, describes a process for providing a retained color image comprising:

(1) imagewise exposing a photosensitive element comprising a support having thereon at least one photosensitive silver halide emulsion layer, the emulsion layer having associated therewith a nondiffusible redox dye releaser;

(2) treating the photosensitive element with an alkaline processing composition in the presence of a silver halide developing agent to effect development of each of the exposed silver halide emulsion layers, thereby oxidizing the developing agent and forming a metallic silver image;

(a) the oxidized developing agent thereby crossoxidizing the redox dye releaser;

(b) the oxidized redox dye releaser then cleaving, thus forming an imagewise distribution of diffusible dye which diffuses out of said element;

(3) bleaching the element to decolorize or destroy any imagewise-released dye which has not diffused out of said element; and (4) removing the metallic silver halide from the element; whereby a dye image is obtained in the element which is the reverse of said metallic silver image. This process is particularly long and difficult as it involves separate wet bleaching and fixing steps.

It has thus been desirable to provide a photographic bleach-fix process for retained image elements using a dry web which can bleach and fix the exposed and developed element.

SUMMARY OF THE INVENTION

It has been discovered, according to the present invention, that an initially photosensitive element can provide a negative or positive dye image by exposing, developing and contacting the element with a bleach-fix sheet comprising a support having thereon a layer and/or layers comprising a silver bleaching agent, a silver halide fixing agent and a hardened hydrophilic binder.

In one embodiment of the invention, a bleach-fix sheet comprises a support having thereon a layer or layers comprising:

(a) a silver bleaching agent;

(b) a silver salt fixing agent; and (c) a hydrophilic binder having a swelling rate T $\frac{1}{2}$ greater than 5 seconds.

In another embodiment of this invention a photographic film unit containing a silver halide developing agent comprises:

(a) an element comprising a support having thereon at least one photosensitive silver halide emulsion layer having associated therewith a dye image-providing material;

(b) a bleach-fix sheet comprising a support having thereon a layer or layers comprising:

(i) a metallic silver bleaching agent, (ii) a silver salt fixing agent, and (iii) a hydrophilic binder having a swelling rate T $\frac{1}{2}$ greater than 5 seconds; and (c) an alkaline processing composition and means for discharging same within said film unit in contact with said photosensitive layer.

In yet another embodiment of this invention, a photographic unit comprises:

(a) an element comprising a support having thereon at least one photosensitive silver halide emulsion layer having associated therewith a dye image-providing material;

(b) a bleach-fix sheet comprising a support having thereon a layer or layers comprising:

(1) a metallic silver bleaching agent, (2) a silver salt fixing agent, and (3) a hydrophilic binder having a swelling rate T ½ greater than 5 seconds; and (c) an alkaline processing composition and means for discharging same within said film unit in contact with said photosensitive layer wherein the film unit contains a silver halide developing agent and optionally (d) a timing layer located between the silver halide emulsion layers and bleach-fix sheet.

In a further embodiment of this invention, a process of producing an image in a photographic element comprises:

imagewise exposing to radiation an element comprising a support having thereon at least one photosensitive silver halide emulsion layer having associated therewith a dye image-providing material developing the image in a processing composition and treating the developed image with a bleach-fix sheet comprising a support having thereon a layer or layers comprising:

(1) a metallic silver bleaching agent, (2) a silver salt fixing agent, and (3) a hydrophilic binder having a swelling rate T ½ greater than 5 seconds.

A still further embodiment of this invention is a process of producing a photographic dye image in a photographic film unit comprising:

(a) an element comprising a support having thereon at least one photosensitive silver halide emulsion layer having associated therewith a dye image-providing material;

(b) a bleach-fix sheet comprising a support having thereon a layer or layers comprising:

(1) a metallic silver bleaching agent, (2) a silver salt fixing agent, and (3) a hydrophilic binder having a swelling rate T ½ greater than 5 seconds; and (c) optionally a timing layer between said element and bleach-fix sheet; and (d) an alkaline processing composition and means for discharging same within said film unit in contact with said photosensitive layer wherein the film unit contains a silver halide developing agent, said process comprising:

(1) imagewise-exposing said film unit to electromagnetic radiation, (2) laminating said film unit so that the alkaline processing composition will permeate the element (a) and element (a) is bleach-fixed, and (3) removing the bleach-fix sheet from element (a).

DETAILED DESCRIPTION OF THE INVENTION

The bleach-fix sheet of this invention comprises a support having thereon a layer or layers comprising:

(a) a metallic silver bleaching agent;

(b) a silver salt fixing agent; and (c) a hydrophilic binder having a swelling rate T ½ greater than 5 seconds.

The support for the bleach-fix sheet can be any material which retains dimensional stability at bleach-fix temperatures. Examples of useful supports are paper, polyolefins such as polyethylene or polypropylene, polycarbonates, cellulose acetate, cellulose acetate butyrate, poly(ethylene terephthalate) and the like. The preferred support material is poly(ethylene terephthalate).

The support contains thereon, in a layer or layers, a metallic silver bleaching agent. Any conventional silver metal bleaching agent can be used. These bleaching agents are conventional in the art and described, for example, in U.S. Pat. Nos. 1,315,464, 1,946,640 and in chapter 30 of *Photographic Chemistry,* Vol. II, P. Glafkides, Foundation Press, London, England. These bleaching agents effectively remove the photographic silver image. Examples of useful silver bleaching agents described in the art include alkali metal dichromate such as sodium dichromate, potassium dichromate, an alkali metal ferricyanide such as potassium ferricyanide, sodium ferricyanide and the like.

Preferred bleaching agents are soluble in water and include ninhydrin, indandione, hexaketocyclohexane, 3,4-dinitrobenzoic acid, 3,5-dinitrobenzoic acid, 2,4-dinitrobenzoic acid, benzoquinone, sulfonic acid, 2,5-dinitrobenzoic acid. Especially preferred bleaching agents include metal organic complexes, for example, derivatives of ferric cyclohexyldiaminotetraacetic acid and ferric ethylenediaminetetraacetic acid, ferric citrates and the like. Generally, the bleaching agent used will depend on the particular element and process employed, pH, solubility, hue, reactivity and the like.

The amount of bleaching agent used in the bleachfix sheet can vary widely, but it is preferred to use a coverage of from about 1.0 to about 100 mmol/$m^2$.

The fixing agent used can be any conventional silver halide complexing agent which either dissolves and removes the silver ion from the emulsion layer or acts as a stabilizing compound which reacts with the silver ion to render it insensitive to light and transparent.

The complexing agent employed herein, in one form, can be that of a conventional silver halide solvent. Silver halide solvents are defined as compounds which, when employed in an aqueous solution (60° C.), are capable of dissolving more than 10 times the amount (by weight) of silver halide which can be dissolved in water at 60° C.

Typical useful silver halide solvents include water-soluble thiosulfates (e.g. sodium thiosulfate, potassium thiosulfate, ammonium thiosulfate and the like), thiourea, ethylenethiourea, a water-soluble thiocyanate (e.g., sodium thiocyanate, potassium thiocyanate and ammonium thiocyanate), and a water-soluble sulfur-containing dibasic acid. Water-soluble diols used to advantage include those having the formula $HO(CH_2CH_2Z)_pCH_2CH_2OH$, wherein p is an integer of from 2 to 13 and Z represents oxygen or sulfur atoms such that at least one third of the Z atoms are sulfur and there are at least two consecutive Z's in the structure of the compound which are sulfur atoms. The diols advantageously used are also included in compounds having the formula $HO(—CH_2CH_2X)_{c-1}(—CH_2CH_2X^1)_{d-1}(—CH_2CH_2X)_{e-1}(CH_2CH_2X^1)_{f-1}(CH_2CH_2X)_{g-1}—CH_2CH_2OH$, wherein X and $X^1$ represent oxygen or sulfur, such that when X represents oxygen, $X^1$ represents sulfur, and when X represents sulfur, $X^1$ represents oxygen, and each of c, d, e, f and g represents an integer of from 1–15, such that the sum of c+d+e+f+g represents an integer of from 6 to 19, and such that at least one third of the total of all the X's plus all the $X^1$'s represents sulfur atoms and at least two consecutive X's and/or $X^1$'s in the structure of the compound are sulfur atoms.

Typical diols include the following:

(1) 3,6-dithia-1,8-octanediol $HOCH_2CH_2SCH_2CH_2SCH_2CH_2OH$;

(2) 3,6,9-trithia-1,11-undecanediol $HOCH_2CH_2SCH_2CH_2SCH_2CH_2SCH_2CH_2OH$;

(3) 3,6,9,12-tetrathia-1,14-tetradecanediol $HO(CH_2CH_2S)_4CH_2CH_2OH$;

(4) 9-oxa-3,6,12,15-tetrathia-1,17-heptadecanediol $HO(CH_2CH_2S)_2CH_2CH_2O(CH_2CH_2S)_2CH_2CH_2OH$;

(5) 9,12-dioxa-3,6,15,18-tetrathia-1,20-eicosanediol $HO(CH_2CH_2S)_2(CH_2CH_2O)_2(CH_2CH_2S)_2(CH_2CH_2OH)$ (6) 3,6-dioxa-9,12-dithia-1,14-tetradecanediol $HO(CH_2CH_2O)_2(CH_2CH_2S)_2CH_2CH_2OH$;

(7) 3,12-dioxa-6,9-dithia-1,14-tetradecanediol $HOCH_2CH_2O(CH_2CH_2S)_2CH_2CH_2OCH_2CH_2OH$;

(8) 3,18-dioxa-6,9,12,15-tetrathia-1,20-eicosanediol $HOCH_2CH_2O(CH_2CH_2S)_4CH_2CH_2OCH_2CH_2OH$;

(9) 12,18-dioxa-3,6,9,15,21,24,27-heptathia-1,29-nonacosanediol $HO(CH_2CH_2S)_3CH_2CH_2OCH_2CH_2SCH_2CH_2O(CH_2CH_2S)_3CH_2CH_2OH$;

(10) 3,12,21-trioxa-6,9,15,18-tetrathia-1,23-tricosanediol $HOCH_2CH_2O(CH_2CH_2S)_2CH_2CH_2O(CH_2CH_2S)_2CH_2CH_2OCH_2CH_2OH$.

Water-soluble sulfur-containing dibasic acids which can be used include those having the formula $HOOCCH_2(SCH_2CH_2)_qSCH_2COOH$, in which q represents an integer of from 1 to 3, and the alkali metal and ammonium salts of said acids. Typical illustrative examples include:

(1) ethylene-bis-thioglycolic acid $HOOCCH_2SCH_2CH_2SCH_2COOH$;

(2) 3,6,9-trithiahendecanedioic acid $HOOCCH_2(SCH_2CH_2)_2SCH_2COOH$;

(3) 3,6,9,12-tetrathiatetradecanedioic acid $HOOCCH_2(SCH_2CH_2)_3SCH_2COOH$;

(4) ethylene-bis-thioglycolic acid disodium salt;
(5) ethylene-bis-thioglycolic acid dipotassium salt;
(6) ethylene-bis-thioglycolic acid diammonium salt;
(7) 3,6,9-trithiahendecanedioic acid disodium salt;
(8) 3,6,9,12-tetrathiatetradecanedioic acid disodium salt.

The fixing agent generally need only be compatible with the hydrophilic binder material. Particularly preferred fixing agents include 5-(2-hydroxyethyl)tetrahydro-s-triazine-2(1H)thione, thioacetamide, 1,3-(di-2-hydroxyethyl)imidazoline-2-thione, imidazoline-2-thione, 1-methylimidazoline-2-thione, 4-methylimidazoline-2-thione, 4-hydroxymethylthiazoline-2-thione, imidazole-2-thione, S,S-di-2-hydroxyethylethane thiol, 5-(2-sulfoethyl)hexahydro-1,3,5-triazine-2-thione ammonium salt and 5-(2-carboxyethyl)hexahydro-1,3,5-triazine-2-thione and the like.

The fixing agent can be present in the bleach-fix sheet in any amount but is preferably present in a coverage of from about 1 to about 100 mmole/$m^2$.

The hydrophilic binder used must have a swelling rate T ½ greater than 5 seconds. The swelling rate of the binder can be measured by any method known in the art, such as the use of a swellometer of the type described in *J. Photo. Sci.*, 20, pp. 205–210 by A. Green and G. I. P. Levenson.

A swelling rate T ½ greater than 5 seconds results in the reactions in the emulsion layers proceeding before water is removed by the cover sheet.

The binder may be hardened to a swelling rate T ½ of greater than 5 seconds by either adding a hardener to the binder or by using a binder which itself is hardened.

If the hydrophilic binder is to be hardened with a separate hardener, the hardener can be added to any conventional hydrophilic binder.

Hydrophilic binders generally useful include, for example, gelatin, polyvinyl alcohol, polyacrylic acid, aldehyde-containing polymers such as described in U.S. Pat. No. 3,625,694; polymers containing active methylene groups such as described in U.S. Pat. No. 3,459,790; 3,488,708; 3,554,987; 3,658,878; 3,929,482 and 3,939,130. Polymeric hardeners useful in combination with proteinaceous binders such as gelatin include polymers containing aziridinyl units such as described in U.S. Pat. No. 3,671,256; polymers with carboxyl and aldehyde or maleimido groups such as described in U.S. Pat. Nos. 3,306,750; 3,296,155; 3,308,075; 3,227,030 and 3,330,664 and dialdehydes of polydextrose as described in U.S. Pat. No. 3,533,800.

The hardener added to the bleach-fix sheet can be any conventional hardening agent. Particularly preferred hardening agents include formaldehyde, bis-vinylsulfonylmethyl ether and the like.

In order to harden the hydrophilic binder so that it has a swelling rate T ½ greater than 5 seconds, at least about 1 to about 10 percent by weight based on the weight of the binder of hardener must be added.

If a separate hardener is not added to the bleach-fix sheet, a polymeric binder mixture can be used to achieve the high T ½ swelling rate. Polymeric binders having this property include polyvinyl alcohol combined with polyacrylic acid and an ethylenediamine tetraacetic acid.

The hardened hydrophilic binders comprise from about 0.5 to about 50 g/$m^2$ of the bleach-fix sheet.

The bleach-fix sheet containing the support, bleaching agent, fixing agent and hardened hydrophilic binder can contain addenda such as coating aids, stabilizers, mordants, sequesterants, acids and the like.

In a particularly preferred embodiment, the bleach-fix sheet contains a layer containing a mordant for dyes. The dye mordant can be any conventional dye mordant capable of holding dyes useful in the photographic unit. The mordant will facilitate the transfer of dye or color-forming material from the photosensitive element and aid in preventing the dye from migrating back to the emulsion sheet prior to separation of the emulsion element and the bleach-fix sheet. Useful mordants include those described in U.S. Pat. Nos. 2,882,156, 2,458,564, 3,625,694, 3,709,690, 3,898,088 and 3,958,995 and the like.

The mordant can be included in the same layer as the bleaching agent, fixing agent and the hardened hydrophilic binder or can be in a separate layer either over or under the layer or layers containing said ingredients.

In a further preferred embodiment, the bleach-fix sheet also contains a polymeric timing layer capable of delaying the bleach-fix reaction until desired silver halide development and colorant or color-forming migration has been substantially completed.

The timing layer can comprise any timing layer such as gelatin, polyvinyl alcohol, polyvinyl alcohol-polyvinyl acetate mixtures and the like such as described in U.S. Pat. No. 3,039,873, and can be barrier timing layers such as described in U.S. patent application Ser. Nos. 676,945 filed Apr. 14, 1976, by Hannie and 676,947 filed Apr. 14, 1976 by Hannie and Ducharme. The timing layer will preferably be coated further from the support than the layer or layers containing the bleaching agent, fixing agent and hardened hydrophilic binder. Advantageously, the timing layer is coated at a thickness of at least 5–50 microns and preferably from 10 to 30 microns; however, the thickness of the timing layer can be varied depending on the strength of the developer used, pH, polymeric materials used and other factors.

In a further preferred embodiment of this invention, the bleach-fix sheet can also contain a polymeric acid for the purpose of lowering the pH to terminate development and/or to initiate the bleaching and fixing reactions. The polymeric acid can be present in any layer of the bleach-fix sheet. Examples of polymeric acids useful herein include poly(acrylic acid), poly(n-butylacrylate-co-acrylic acid), polystyrene sulfonic acid, polyvinyl hydrogen phthalate, polymethacrylic acid, poly(methyl vinyl ether-co-maleic anhydride) and other neutralizing materials such as disclosed in *Research Disclosure,* July 1974, No. 12331 and the like.

The bleach-fix sheet can be prepared by simply coating a support material by any conventional coating method with a layer comprising the bleaching agent, fixing agent and hardened hydrophilic binder, generally in aqueous solution and optionally overcoating with an acid layer and/or a timing layer. The bleach-fix sheet can be any thickness, but it is preferred to use a sheet having a thickness of about 10 to 100 microns and the total thickness of the bleach-fix cover sheet (excluding support) is preferably from about 25 to about 250 microns.

A preferred bleach-fix sheet comprises a support having thereon at least one layer comprising:

(a) a metallic silver bleaching agent;

(b) a silver salt fixing agent; and (c) a hydrophilic binder comprising gelatin having been hardened to the swelling rate T $\frac{1}{2}$ greater than 5 seconds by pretreatment with a hardener. A most preferred bleach-fix sheet comprises a support having thereon a single layer or plurality of layers comprising:

(a) 5-(2-hydroxyethyl)tetrahydro-s-triazine-2-(1H)thione;

(b) gelatin hardened with bis-vinylsulfonylmethyl ether; and (c) 2,5-dinitrobenzoic acid.

A photographic film unit containing a silver halide developing agent, according to this invention, can comprise:

(a) an element comprising a support having thereon at least one photosensitive silver halide emulsion layer having associated therewith a dye image-providing material;

(b) a bleach-fix sheet comprising a support having thereon a single layer or plurality of layers comprising:

(i) a metallic silver bleaching agent, (ii) a silver salt fixing agent, and (iii) a hydrophilic binder comprising hardened gelatin having a swelling rate T $\frac{1}{2}$ greater than 5 seconds; and (c) an alkaline processing composition and means for discharging same within said film unit in contact with said photosensitive layer, wherein, upon discharge of said processing composition, said silver halide is developed imagewise, the developing metallic silver is bleached, and the silver halide is fixed, leaving a dye image.

The bleach-fix sheet can be used to remove the silver and silver halide from conventional photographic elements containing photosensitive silver halide emulsions having associated therewith a color providing material such as a dye-forming color coupler such as phenols, naphthols, pyrazolones, open-chain ketomethylenes and the like. In this process, the imagewise exposed element is developed in a processing solution containing a primary aromatic amine color developer such as 4-amino-3-methyl-N-ethyl-N-$\beta$-(methanesulfonamido)ethylanilino sulfate hydrate; 4-amino-3-methyl-N,N-diethylaniline hydrochloride, and the like to form a dye image. The element is then treated by contacting it with the bleach-fix sheet of this invention.

The bleach-fix sheet can be used to remove the silver and silver halide from any photographic element, but is particularly useful in a color image-transfer process wherein an image retained in the initially photosensitive element is used.

A process for producing a color image according to this invention comprises:

(a) developing under alkaline conditions with a silver halide developing agent an imagewise-exposed photosensitive element comprising a transparent or opaque support having thereon at least one photosensitive, silver halide emulsion layer, each silver halide emulsion layer having associated therewith a dye image-providing material preferably comprising a nondiffusible sulfonamidoaniline or a sulfonamidophenol which is alkali-cleavable upon oxidation to release a diffusible color-providing moiety from the benzene nucleus;

(b) said developing agent thereby becoming oxidized as a function of said development;

(c) the oxidized developing agent thereby cross-oxidizing each alkali-cleavable compound to cause the compound to cleave, thus forming an imagewise distribution of diffusible color-providing moiety as a function of the imagewise exposure of each of the silver halide emulsion layers;

(d) causing each imagewise distribution of diffusible color-providing moiety to diffuse out of the element; and (e) removing residual silver and silver halide from the element using the bleach-fix sheet, whereby a color image is obtained in said element comprising residual nondiffusible compound.

It will be seen that the above process provides a color image in two basic steps. The first step comprises development with a black-and-white developing agent. The second step comprises removal of the diffusible color-providing moiety along with residual silver and silver halide from the element. Of course, wash steps may be employed in the process where appropriate.

If a negative-working silver halide emulsion is employed in the photosensitive element, then a positive color image, such as a color transparency or motion picture film, is produced. If a direct-positive silver halide emulsion is employed in the photosensitive element, then a negative color image is produced.

The image former can be initially mobile dye-providing compounds, as well as initially immobile dye-providing compounds. Initially mobile dye-providing compounds are described in, for example, U.S. Pat. Nos. 3,563,739; 2,543,691; 3,705,184; 2,983,606; 3,482,972; 3,255,001 and 2,774,668. Examples of initially immobile dye-providing compounds are those described in U.S. Pat. Nos. 3,698,897; 3,725,062; 3,227,550; 3,443,939; 3,980,479; 4,055,428; and 4,076,529; British Pat. No. 1,489,695 and U.S. application Ser. No. 326,628 and the like.

The image dye-providing materials useful with the silver halide emulsions may also be represented by the following formula:

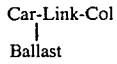

wherein:

(1) Col preferably is a dye, dye precursor or other color-forming material;

(2) Ballast is an organic ballasting radical of such molecular size and configuration as to render said alkali-cleavable compound nondiffusible during development in an alkaline processing composition;

(3) Link is a redox-sensitive divalent linking group for the carrier and the color-forming material such as $NHSO_2$ and the like; and (4) Car is an oxidizable acyclic, carbocyclic or heterocyclic moiety such as described in *Research Disclosure* 15157, Volume 151.

In one embodiment, the color-forming material preferably has the formula:

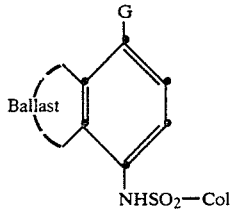

wherein:

G is OR or $NHR_1$;

R is hydrogen or a hydrolyzable moiety;

$R_1$ is hydrogen or an alkyl group; and

Ballast and Col are as described above.

In the formula listed above for the compounds which are alkali-cleavable upon oxidation, R is preferably hydrogen, although it could be any hydrolyzable entity well-known to those skilled in the art, e.g., acetyl, mono-, di- or trichloroacetyl radicals, perfluoracyl, pyruvyl, alkoxyacyl, nitrobenzoyl, cyanobenzoyl, sulfonyl, sulfinyl, etc.

In the above formula describing the compounds, $R_1$ is preferably hydrogen although it could be an alkyl group, including a substituted alkyl group, of from 1 to 22 carbon atoms which could serve as the ballast group indirectly attached to the ring as defined below.

The nature of the ballast group in the formula for the compounds described above (Ballast) is not critical as long as it confers nondiffusibility to the compounds. Typical ballast groups include long-chain alkyl radicals linked directly or indirectly to the compound as well as aromatic radicals of the benzene and naphthalene series indirectly attached or fused directly to the benzene nucleus, etc. Useful ballast groups generally have at least 8 carbon atoms and may even comprise a polymer backbone or a dye or dye precursor (Col) as defined below, e.g.:

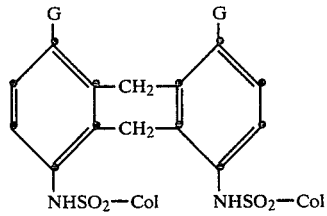

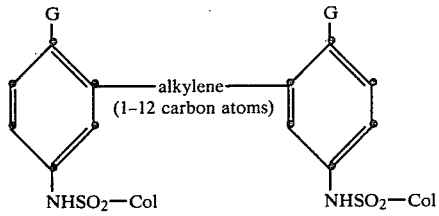

etc., wherein G and Col have the same definitions as in the formula above.

In addition to Ballast, the benzene nucleus in the above formula may have groups attached thereto such as halogens, alkyl, aryl, alkoxy, aryloxy, nitro, amino, alkylamino, arylamino, amido, cyano, alkylmercapto, keto, carboalkoxy, etc. In addition, such groups may combine together with the carbon atoms to which they are attached on the ring to form another ring which may be saturated or unsaturated including a carbocyclic ring, a heterocyclic ring, etc.

As previously mentioned, Col in the above formula represents a dye or dye precursor or other color-forming materials. Such compounds are well-known to those skilled in the art and include dyes such as azo, azomethine, indoaniline, indophenol, anthraquinone, triarylmethane, merocyanine, nitro, quinoline, cyanine, indigoide, phthalocyanine, etc., and dye precursors such as a leuco dye, a "shifted" dye which shifts hypsochromically or bathochronically when subjected to a different environment such as a change in pH, reaction with a material to form a complex, etc., couplers such as a phenol, naphthol, indazolone, open-chain benzoyl acetanilide, pivalylacetanilide, malonamide, malonanilide, cyanoacetyl, coumarone, pyrazolone, compounds described in U.S. Pat. No. 2,756,142, etc.

When dye precursors are employed in this process instead of dyes, they are converted to dyes by means well-known to those skilled in the art, either in the photosensitive element or in the processing composition, to form a visible dye. Such techniques are disclosed, for example, in British Pat. Nos. 1,157,501, 1,157,502, 1,157,503, 1,157,504, 1,157,505, 1,157,506, 1,157,507, 1,157,508, 1,157,509 and 1,157,510 and U.S. Patent Nos. 2,774,668, 2,698,798, 2,698,244, 2,661,293 and 2,559,643, etc.

This invention may be used to produce positive or negative images in single- or multicolors. In a three-color system, each silver halide emulsion layer of the photosensitive element will have associated therewith a dye image-providing material possessing a spectral absorption range substantially complementary to the predominant sensitivity range of its associated emulsion, i.e., the blue-sensitive silver halide emulsion layer will have a yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained in either the silver halide emusion layer itself or a layer contiguous the silver halide emulsion layer.

The concentration of the alkali-cleavable compounds that are employed in the present invention may be varied over a wide range depending upon the particular compound employed and the results which are desired. For example, alkali-cleavable dye image-providing compounds of the present invention may be coated in layers by using coating solutions containing between about 0.5 and about 8 percent by weight of the dye image-providing compound distributed in a hydrophilic film-forming natural material or synthetic polymer, such as gelatin, polyvinyl alcohol, etc., which is adapted to be permeated by aqueous alkaline processing composition.

Any silver halide developing agent can be employed in this invention, as long as it crossoxidizes with the alkali-cleavable compounds described herein. The developer may be employed in the photosensitive element to be activated by an alkaline processing composition. Specific examples of such developers which can be employed in this invention include:

hydroquinone,
N-methylaminophenol,
Phenidone (1-phenyl-3-pyrazolidone),
Dimezone (1-phenyl-4,4-dimethyl-3-pyrazolidone),
4-hydroxymethyl-4-methyl-1-phenyl-3-pyrazolidone,
N,N,N',N'-tetramethyl-p-phenylenediamine, etc.

These materials are employed in an alkaline solution and can contain conventional addenda well-known to those skilled in the photographic art.

As was mentioned previously, the silver halide developer in this process becomes oxidized upon development and reduces silver halide to silver metal. The oxidized developer then crossoxidizes the alkali-cleavable compound, causing it to cleave, thus forming an imagewise distribution of diffusible dye or dye precursor which then diffuses out of the element. The diffusible moiety is transferable in alkaline processing composition either by virtue of its self-diffusivity or by having attached to it one or more solubilizing groups such as COOH, $SO_3N$, $CONH_2$, $SO_2NHX$, $CONHX^-$ where X is aryl or alkyl, OH, SN, etc.

The silver halide emulsions useful in this invention are well-known to those skilled in the art and are described in *Product Licensing Index,* Vol. 92, December, 1971, publication 9232, page 107, paragraph I, "emulsion types"; they may be chemically and spectrally sensitized as described on page 107, paragraph III, "Chemical sensitization" and pages 108–109, paragraph IV, "Spectral sensitization" of the above article; they can be protected against the production of fog and can be stabilized against loss of sensitivity during keeping by employing the materials described on page 107, paragraph V, "Antifoggants and stabilizers" of the above article; they can contain development modifiers, hardeners and coating aids as described on pages 107–108, paragraph IV, "Development modifiers", paragraph VII, "Hardeners", and paragraph XII, "Coating aids" of the above article; they and other layers in the photographic elements used in this invention can contain the vehicles described on page 108, paragraph VIII, "Vehicles" of the above article; they may be coated on any of the transparent supports described on page 108, paragraph X, "Supports" of the above article; and they can be coated by using the various techniques described on page 109, paragraph XVIII, "Coating procedures" of the above article; the disclosures of which are hereby incorporated by reference.

The process is carried out in any of a variety of ways. The light-sensitive element can be first exposed and dipped in developer solution and then contacted with the bleach-fix sheet and subsequently separated from the bleach-fix sheet to leave a retained image in the emulsion element. If the support for the emulsion element is transparent, a transparency is achieved, and if the support for the emulsion is opaque, a reflection print is obtained.

Alternatively, and in the preferred embodiment, the element containing the silver halide emulsion is placed over the bleach-fix sheet with a means for discharging processing composition between the emulsion sheet and the bleach-fix sheet. The composite can then be exposed and the bleach-fix sheet can be pressed to the emulsion layer, thus releasing the processing composition to develop the emulsion layer imagewise. If the timing layer is present in the bleach-fix sheet, the processing will be complete when the bleach-fix reactions take effect to provide the retained color image in the emulsion layer. The bleach-fix sheet is then removed from the emulsion-containing element and the positive or negative image is retained in color in the emusion layer. If desired, the corresponding negative or positive image can be used on the bleach-fix sheet if the bleach-fix sheet contains a mordant layer to retain this transferred dye image.

It is noted that that the term "in association with" used throughout the specification and claims means that the silver halide emulsion and the image-forming material are either in the same layer or in contiguous layers or close to each other such that the development of the silver halide would oxidize the carrier of the image-forming material.

Using the bleach-fix sheets of this invention, a simple method of obtaining retained images without the need for multiple processing steps and excess physical handling can be used. Satisfactory results were not attainable using bleach-fix solutions or bleach-fix sheets using unhardened or inadequately hardened binders for the bleaching agent and fixing agent.

The following examples further illustrate the invention.

EXAMPLE 1

Bleach-Fix Cover Sheet with Acid Layer

A bleach-fix cover sheet was prepared comprising a poly(ethylene terephthalate) film support having coated thereon (1) a first layer containing 4100 mg/ft$^2$ (84.2 g/m$^2$) of 5-(2-hydroxyethyl)tetrahydro-s-triazine-2(1H)thione (HTTT) and 2000 mg/ft$^2$ (21.6 g/m$^2$) of gelatin hardened with bis-vinylsulfonylmethyl ether and (2) a second layer containing 1500 mg/ft$^2$ (16.2 g/m$^2$) of poly(n-butyl acrylate-co-acrylic acid) (70 weight percent acrylic acid) and 424 mg/ft$^2$ (4.58 g/m$^2$) of 2,5-dinitrobenzoic acid.

The effective fixing rate of the cover sheet was tested by spreading a portion of an aqueous viscous activator comprising 60g/l of potassium hydroxide and 25 g/l hydroxyethyl cellulose between a sample of the cover sheet and an unexposed, undeveloped film sample containing a gelatinous silver bromide emulsion (0.8$\mu$ grain size) coated at 500 mg Ag/ft$^2$ (5.4 g/m$^2$). The sandwich remained laminated and the rate of fixing was measured by following the disappearance of light scattering in the silver halide element at 360–400 nm using a Unicam spectrophotometer. The fixing rate of 500 mg/ft$^2$ (5.4 g/m$^2$) of silver halide was 100 seconds.

The bleaching rates of the bleach-fix sheet were measured by employing predeveloped samples of films containing 100, 200 and 500 mg of developed silver/ft$^2$ (1.08, 2.16 and 5.4 g Ag°/m$^2$), respectively. Samples of the cover sheet were brought into contact with the predeveloped film samples, and a viscous activator comprising a 10.3% aqueous solution of hydroxyethyl cellulose adjusted to pH 4.0 with phthalic acid was spread between. The bleach rates were monitored by measurement of the infrared density as a function of time. The cover sheet was effective in bleaching the sample containing 100 mg Ag°/ft$^2$ in 15 seconds, 200 mg Ag°/ft$^2$ in 40 seconds and 500 mg Ag°/ft$^2$ in 200 seconds, respectively.

EXAMPLE 2

Several bleach-fix cover sheets were prepared as described in Example 1 except that the following various combinations of bleaching agents and fixing agents were employed at the same molar ratios as in Example 1.

| Cover Sheet | Bleaching Agent | Fixing Agent |
|---|---|---|
| A | ninhydrine | HTTT |
| B | indandione | HTTT |
| C | hexaketocyclohexane | HTTT |
| D | 3,4-dinitrobenzoic acid | HTTT |
| E | 3,5-dinitrobenzoic acid | HTTT |
| F | 2,4-dinitrobenzoic acid | HTTT |
| G | 2,4-dinitrobenzene-sulfonic acid | HTTT |
| H | benzoquinone sulfonic acid | HTTT |
| I | 2,5-dinitrobenzoic acid | thioacetamide |
| J | 2,5-dinitrobenzoic acid | 1,3-(di-2-hydroxyethyl)imidazoline-2-thione |
| K | 2,5-dinitrobenzoic acid | imidazoline-2-thione |

-continued

| Cover Sheet | Bleaching Agent | Fixing Agent |
|---|---|---|
| L | 2,5-dinitrobenzoic acid | 1-methylimidazoline-2-thione |
| M | 2,5-dinitrobenzoic acid | 4-methylimidazoline-2-thione |
| N | 2,5-dinitrobenzoic acid | 4-hydroxymethylthiazoline-2-thione |
| O | 2,5-dinitrobenzoic acid | imidazole-2-thione |
| P | 2,5-dinitrobenzoic acid | S,S-di-2-hydroxyethylethane thiol |

After testing as described in Example 1, it was apparent that all cover sheets were successful in bleaching and fixing the photographic element.

EXAMPLE 3

Samples of a conventional color reflection print material comprising red-, green- and blue-sensitive silver halide emulsion layers having incorporated therein cyan, magenta and yellow dye-forming couplers, respectively, were exposed through a multicolor, graduated-density test object and developed for 3½ minutes at 88° F. (31° C.) in a conventional color developing solution. Development was stopped by immersion in an acetic acid stop bath for 1 minute at 31° C. and then washed in water for 2 minutes.

One developed sample, acting as a control, was treated in the bleach-fix solution described below for 1½ minutes at 31° C. and washed for 2 minutes.

| Bleach-Fix Solution (Control) | |
|---|---|
| ammonium ferric ethylenediaminetetraacetic acid(EDTA) | 65.6 g |
| ammonium thiosulfate | 132 g |
| sodium bisulfite | 13 g |
| ammonium EDTA | 6.56 g |
| ammonium hydroxide (28% solution) | 27.9 ml |
| water to 1.0 liter; pH 6.68 | |

The processed sample produced a color reflection print having a maximum infrared density of 0.02–0.03, indicating the silver and silver halide had been removed.

A second developed sample was laminated to a bleach-fix sheet by using a roller set with a 0.008-inch gap while a portion of an aqueous solution comprising $NaHSO_3$ (10 g/l), NaOAc (10 g/l) and hydroxyethyl cellulose (25 g/l) adjusted to pH 5.0 with acetic acid was spread between. The samples remained laminated for 2 minutes and were then separated.

The bleach-fix cover sheet consisted of a poly(ethylene terephthalate) film support having coated thereon a layer containing:

| | | |
|---|---|---|
| HTTT | 1800 mg/ft$^2$ | (19.4 g/m$^2$) |
| $[(HOCH_2CH_2)_3NHFeEDTA]$ | 1100 mg/ft$^2$ | (11.9 g/m$^2$) |
| mordant* | 300 mg/ft$^2$ | (3.2 g/m$^2$) |
| gelatin | 2000 mg/ft$^2$ | (21.6 g/m$^2$) |

-continued

| | | |
|---|---|---|
| formaldehyde | 140 mg/ft$^2$ | (1.5 g/m$^2$) |

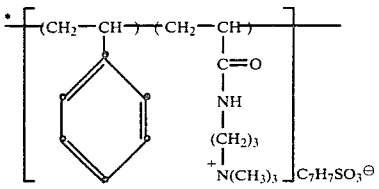

After separation, the sample was washed and dried. A clean and shiny color reflection print equivalent to the control was produced using the dry sheet. A maximum infrared density of only 0.03 indicated that bleach-fixing was complete.

EXAMPLE 4

A color negative film product (Kodacolor II, Type 8035) was imagewise-exposed and developed for 3¼ minutes at 100° F. (38° C.) in a conventional color developing solution.

After development, the film was laminated as described in Example 3, employing a 0.016-inch roller gap, a neutral viscous activator comprising a 1.5% aqueous solution of hydroxyethyl cellulose, and a bleach-fix sheet comprising a poly(ethylene terephthalate) film support having coated thereon a layer containing gelatin at 2.0 g/ft$^2$ (21.6 g/m$^2$), HTTT at 2.0 g/ft$^2$ (21.6 g/m$^2$), formaldehyde at 270 mg/ft$^2$ (2.9 g/m$^2$) and tetraethylammonium ferric EDTA at 1.2 g/ft$^2$ (12.9 g/m$^2$).

After separation and washing, a clean color negative was obtained. Measurement of the maximum infrared density indicated that the silver and silver halide had been removed (I.R. density=0.06).

EXAMPLE 5

A bleach-fix cover sheet was prepared comprising a poly(ethylene terephthalate) film support having coated thereon 2-mercaptoimidazolidine at 1.0 g/ft$^2$ (10.8 g/m$^2$), triethanol ammonium ferric EDTA [$(HOCH_2CH_2)_3NHFeEDTA$] at 1.0 g/ft$^2$ (10.8 g/m$^2$), polyvinyl alcohol at 500 mg/ft$^2$ (5.4 g/m$^2$) and polyacrylic acid at 200 mg/ft$^2$ (2.16 g/m$^2$).

The cover sheet was prepared by dissolving 15 g of 2-mercaptomidazalidine and 15 g of $(HOCH_2CH_2)_3NHFeEDTA$ in 100 ml of hot water and filtering; 70 ml of a 10% aqueous solution of polyvinyl alcohol were added with stirring; 25 ml of a 15% aqueous solution of polyacrylic acid and 10 ml of p-t-octylphenoxy polyethoxyethanol surfactant were then added with stirring. The mixture was then coated at 16 ml/ft$^2$ at 140° F. Upon drying at 140° F., the polyvinyl alcohol vehicle had been hardened by polyacrylic acid in the presence of $(HOCH_2CH_2)_3NHFeEDTA$.

The bleach-fixing efficiency was tested as described in Example 1. Upon lamination, 200 mg of developed silver/ft$^2$ were bleach-fixed in 120 seconds.

EXAMPLE 6

A bleach-fix cover sheet was prepared comprising a poly(ethylene terephthalate) film support having coated thereon (1) a bleach-fix layer containing 5-(2-hydroxyethyl)-tetrahydro-s-triazine-2(1H)thione at 1.8 g/ft$^2$ (19.4 g/m$^2$), triethanolammonium ferric ethylenediaminetetraacetic acid at 1.1 g/ft$^2$ (11.8 g/m$^2$), octadecyl tributyl ammonium bromide at 300 mg/ft$^2$ (3.24 g/m$^2$), formaldehyde at 140 mg/ft$^2$ (1.5 g/m$^2$) and gelatin at 2.0 g/ft$^2$ (21.6 g/m$^2$) and (2) a timing layer containing polyvinylacetalphthalate at 1.0 g/ft$^2$ (10.8 g/m$^2$).

A multilayer color photographic element adapted for a retained-image process was prepared according to the following schematic structure. Coverages are stated in parentheses in terms of mg/ft$^2$ and g/m$^2$ respectively.

| | |
|---|---|
| Layer 6 | gelatin (50; 0.54); bis(vinylsulfonylmethyl ether) (0.375; 0.004) |
| Layer 5 | red-sensitive negative AgX (85 Ag; 0.92 Ag); 1-phenyl-5-mercaptotetrazole (0.025; 0.0003); Dye A (62; 0.67); 4,4-dimethyl-1-phenyl-3-pyrazolidone (4; 0.04); gelatin (115; 1.24) |
| Layer 4 | gelatin (75; 0.81); bis(vinylsulfonylmethyl ether) (0.56; 0.006) |
| Layer 3 | green-sensitive negative AgX (85 Ag; 0.92 Ag); 1-phenyl-5-mercaptotetrazole (0.025; 0.0003); Dye B (88; 0.95); 4,4-dimethyl-1-phenyl-3-pyrazolidone (4; 0.04); gelatin (140; 1.5) |
| Layer 2 | gelatin (75; 0.81); bis(vinylsulfonylmethyl ether) (0.56; 0.006); Carey Lea silver (10; 0.11) |
| Layer 1 | blue-sensitive negative AgX (85 Ag; 0.92 Ag); 1-phenyl-5-mercaptotetrazole (0.025; 0.0003); Dye C (80; 0.86); 4,4-dimethyl-1-phenyl-3-pyrazolidone (4; 0.004); gelatin (145; 1.55) |
| | poly(ethylene terephthalate) support |

Compound Identification

Dye A (Cyan dye-providing compound)

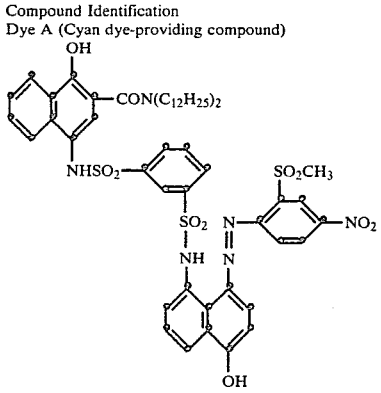

Dye B (Magenta dye-providing compound)

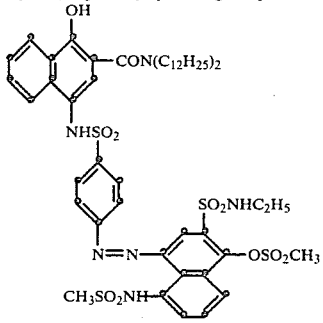

Dye C (Yellow dye-providing compound)

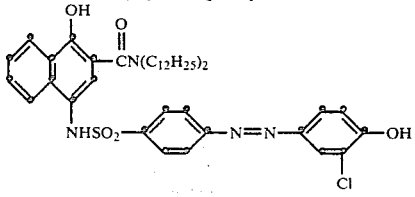

A sample of the multilayer color photographic element prepared above was imagewise-exposed through the support using a graduated-density test object and red, green and blue filtered light sources, each focused on a separate portion of the element.

The exposed sample was laminated to the above bleach-fix cover sheet in the absence of light with a portion of a viscous activator solution spread between at 0.008-inch thickness, using a pair of juxtaposed pressure rollers. The viscous activator comprised a solution of 30 g of hydroxyethyl cellulose, 25 g of potassium hydroxide and 15 g of 11-aminoundecanoic acid per liter of water.

After 7 minutes, the laminated unit was separated. The retained positive dye images were transparent and dry to the touch. Infrared density measurements of the processed photographic element indicated that no residual silver metal remained. (Infrared density in developed areas was 0.02 vs. 0.01 in undeveloped areas.)

X-ray analysis of the bleach-fix cover sheet showed that approximately 90 to 95% of the silver from the photographic element was recovered in the cover sheet.

EXAMPLE 7

A bleach-fix cover sheet was prepared comprising a poly(ethylene terephthalate) film support having coated thereon (1) a bleach-fix layer containing 5-(2-hydroxyethyl)-tetrahydro-s-triazine-2(1H)thione at 1.8 g/ft$^2$ (19.4 g/m$^2$), triethanolammonium ferric ethylenediamine tetraacetic acid at 1.1 g/ft$^2$ (11.9 g/m$^2$), mordant A* at 300 mg/ft$^2$ (3.24 g/m$^2$), formaldehyde at 140 mg/ft$^2$ (1.5 g/m$^2$) and gelatin at 2.0 g/ft$^2$ (21.6 g/m$^2$) and (2) a timing layer containing polyvinylacetalphthalate at 1.5 g/ft$^2$ (16.2 g/m$^2$).

*Mordant A

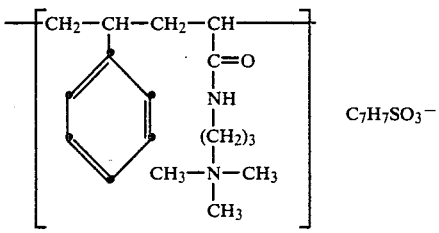

A multilayer color photographic element adapted for a retained-image process was prepared according to the following schematic structure. Coverages are stated in parentheses in terms of mg/ft$^2$ and g/m$^2$ respectively.

| | |
|---|---|
| Layer 6 | gel (50; 0.54); bis(vinylsulfonylmethyl ether) (0.5; 0.0054) |
| Layer 5 | blue-sensitive negative AgX (85 Ag; 0.92 Ag); Dye D* (95; 1.02); gel (150; 1.62) |
| Layer 4 | gelatin (75; 0.81); bis(vinylsulfonylmethyl ether) (0.75; 0.0081) |
| Layer 3 | green-sensitive negative AgX (85 Ag; 0.92 Ag); Dye B (90; 0.97); gelatin (150; 1.62) |
| Layer 2 | gelatin (75; 0.81); bis(vinylsulfonylmethyl ether) (0.75; 0.0081) |
| Layer 1 | red-sensitive negative AgX (85 Ag; 0.92 Ag); Dye E** (70; 0.755); gelatin (125; 1.35) |
| | poly(ethylene terephthalate) support |

-continued

*Dye D (Yellow dye-providing compound)

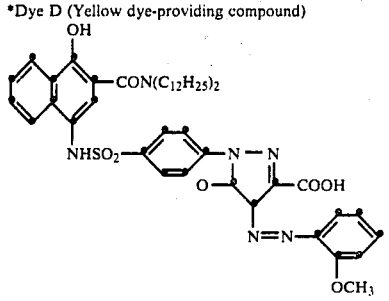

**Dye E (Cyan dye-providing compound)

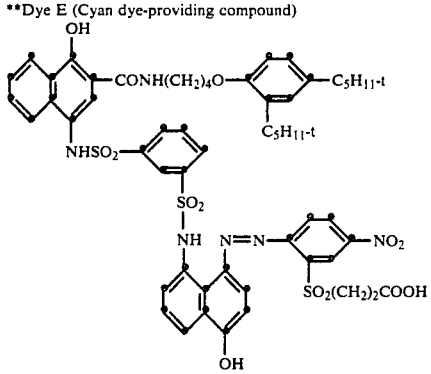

A sample of the multilayer color photographic element prepared above was imagewise-exposed using a graduated-density test object and red, green and blue filtered light sources, each focused on a separate portion of the element.

The exposed sample was laminated to the above bleach-fix cover sheet in the absence of light with a portion of a viscous activator solution spread therebetween at 0.007-inch thickness, using a pair of juxtaposed pressure rollers. The viscous activator comprised a solution of 30 g of hyroxyethyl cellulose, 40 g of potassium hydroxide, 15 g of 11-aminoundecanoic acid, 4 g of 4,4-dimethyl-1-phenyl-3-pyrazolidone and ;b 0.1 g of piperidinohexosereductone per liter of water. After 10 minutes, the laminated unit was separated. The retained positive dye images were transparent and dry to the touch. Infrared density measurements of the processed photographic element indicated that no residual silver metal reamined. (Infrared densities in developed areas were 0.02 vs. 0.01 in undeveloped areas.) The following dye densities were measured:

$D_{min}$: R, 0.71; G, 0.53; B, 0.55

$D_{max}$: R, 1.79; G, 2.22; B, 2.17.

In addition to the positive images produced in the initially light-sensitive element, well-defined negative color images were observed in the bleach-fix cover sheet which were suitable for the subsequent production of reflection prints or positive transparencies.

The invention has been described in detail with particular reference to preferred embodiments thereof, but it will be understood that variations and modifications can be effected within the spirit and scope of the invention.

What are claimed are:

1. A bleach-fix sheet comprising a support having thereon at least one layer comprising:

(a) a metallic silver bleaching agent;

(b) a silver salt fixing agent; and (c) a hydrophilic binder having a swelling rate T ½ greater than 5 seconds.

2. The bleach-fix sheet of claim 1 wherein the metallic silver bleaching agent is water-soluble.

3. The bleach-fix sheet of claim 1 wherein the silver salt fixing agent is present at a concentration of from about 1 to about 100 mmole/$m^2$.

4. The bleach-fix sheet of claim 1 wherein the silver bleaching agent is present at a concentration of from about 1 to about 100 mmole/$m^2$.

5. The bleach-fix sheet of claim 1, the hydrophilic binder having been hardened to the swelling rate T ½ greater than 5 seconds by pretreatment with a hardener.

6. The bleach-fix sheet of claim 5 wherein said hydrophilic binder is hardened gelatin.

7. The bleach-fix sheet of claim 1 wherein the hydrophilic binder is poly(vinyl alcohol) hardened by polyacrylic acid and triethanolammonium ferric ethylenediaminetetraacetic acid.

8. The bleach-fix sheet of claim 1 wherein the hydrophilic binder is present at a concentration of from about 0.5 to about 50 g/$m^2$.

9. The bleach-fix sheet of claim 1 additionally comprising a layer containing a mordant for dyes.

10. A bleach-fix comprising a support having thereon at least one layer comprising:

(a) a metallic silver bleaching agent;

(b) a silver salt fixing agent;

(c) a hydrophiic binder having a swelling rate T ½ greater than 5 seconds; and (d) a polymeric timing layer which temporarily delays a bleaching and fixing reaction.

11. The bleach-fix sheet of claim 1 additionally containing a polymeric acid.

12. A bleach-fix sheet comprising a support having thereon a single layer or plurality of layers comprising:

(a) 5-(2-hydroxyethyl)tetrahydro-s-triazine-2-(1H)thione;

(b) gelatin hardened with bis-vinylsulfonylmethyl ether; and (c) 2,5-dinitrobenzoic acid.

13. A photographic film unit containing a silver halide developing agent, said film unit comprising:

(a) an element comprising a support having thereon at least one photosensitive silver halide emulsion layer having associated therewith a dye image-providing material;

(b) a bleach-fix sheet comprising a support having thereon a single layer or plurality of layers comprising:

(i) a metallic silver bleaching agent, (ii) a silver salt fixing agent, and (iii) a hydrophilic binder having a swelling rate T ½ greater than 5 seconds; and (c) an alkaline processing composition and means for discharging same within said film unit in contact with said photosensitive layer, wherein, upon discharge of said processing composition, said silver halide is developed imagewise, the developing metallic silver is bleached, and the silver halide is fixed, leaving a dye image.

14. The photographic film unit of claim 13 wherein said dye-bleach sheet contains a mordant for the dye provided by said dye image-providing materials.

15. The photographic film unit of claim 14 wherein the dye-bleach sheet additionally comprises a timing layer to delay operation of said bleaching and fixing agents.

16. The photographic film unit of claim 13 wherein the metallic silver bleaching agent is water-soluble.

17. The photographic film unit of claim 13 wherein the silver salt fixing agent is present in a concentration of from about 1 to about 100 mmoles/$m^2$.

18. The photographic film unit of claim 13 wherein the metallic silver bleaching agent is present in a concentration of from 1 to about 100 mmoles/$m^2$.

19. The photographic film unit of claim 13 wherein the hydrophilic binder is hardened to the swelling rate T ½ greater than 5 seconds by pretreatment with a hardener.

20. The photographic film unit of claim 13 wherein said hydrophilic binder is hardened gelatin.

21. The photographic film unit of claim 13 wherein the hydrophilic binder is poly(vinyl alcohol) hardened by polyacrylic acid and triethanolammonium ferric ethylenediaminetetraacetic acid.

22. The photographic film unit of claim 13 wherein the hydrophilic binder is present in a concentration of from 0.5 to 50 g/$m^2$.

23. The photographic film unit of claim 13 wherein the element (a) comprises a photosensitive element comprising a transparent support having thereon the following layers in sequence: an image-receiving layer; an alkaline solution-permeable, light-reflective layer; an alkaline solution-permeable, opaque layer; a red-sensitive silver halide emulsion layer having a ballasted redox cyan dye image-providing material associated therewith; a green-sensitive silver halide emulsion layer having a ballasted therewith; and a blue-sensitive silver halide emulsion layer having a ballasted redox yellow dye image-providing material associated therewith.

24. An image-transfer film unit containing a silver halide developing agent, said film unit comprising:

(a) an element comprising a support having thereon at least one photosensitive silver halide emulsion layer having associated therewith a dye image-providing material;

(b) a bleach-fix sheet comprising a support having thereon a single layer or plurality of layers comprising:

(i) a metallic silver bleaching agent, (ii) a silver salt fixing agent, and (iii) a hydrophilic binder having a swelling rate T ½ greater than 5 seconds, said bleach-fix sheet comprising a dye-imaging layer; and (c) an alkaline processing composition and means for discharging same within said film unit in contact with said photosensitive layer, wherein, upon discharge of said processing composition, said silver halide is developed imagewise, the developing metallic silver is bleached, and the silver halide is fixed, leaving a dye image.

25. A process of producing a photographic image in a photographic film unit comprising an element comprising a support having thereon at least one photosensitive silver halide emulsion layer having associated therewith a dye image-providing material, said process comprising imagewise exposing said element to radiation, developing the image in a processing composition and treating the developed image with a bleach-fix sheet comprising a support having thereon a single layer or plurality of layers comprising:

(1) a metallic silver bleaching agent;

(2) a silver salt fixing agent; and (3) a hydrophilic binder having a swelling rate T ½ greater than 5 seconds.

26. The process of claim 25 wherein the dye image-providing material is a color coupler and the processing composition contains a color developer.

27. A process of producing a photographic transfer image in a photographic film unit comprising:

(a) an element comprising a support having thereon at least one photosensitive silver halide emulsion layer having associated therewith a dye image-providing material;

(b) a bleach-fix sheet comprising a support having thereon a single layer or plurality of layers comprising:

(i) a metallic silver bleaching agent, (ii) a silver salt fixing agent, and (iii) a hydrophilic binder having a swelling rate T ½ greater than 5 seconds; and (c) an alkaline processing composition and means for discharging same within said film unit in contact with said photosensitive layer wherein the film unit contains a silver halide developing agent, said process comprising:

(i) imagewise-exposing said film unit to electromagentic radiation, (ii) laminating said film unit so that the alkaline processing composition will permeate the element (a) and element (a) will be bleach-fixed by bleach-fix sheet (b), and (iii) removing the bleach-fix sheet from element (a).

28. The process of claim 27 wherein said bleach-fix sheet additionally contains a polymeric timing layer which temporarily delays the bleach-fix reaction.

29. The process of claim 27 wherein said bleach-fix sheet additionally contains a mordant for dyes.

30. A process of producing a photographic transfer image in a photographic film comprising:

(a) imagewise-exposing a photosensitive element comprising a support having thereon at least one photosensitive silver halide emulsion layer having associated therewith a dye image-providing material;

(b) treating the exposed element with alkaline processing solution in the presence of a silver halide developing agent; and (c) contacting the element with a bleach-fix sheet comprising:

(i) a metallic silver bleaching agent, (ii) a silver salt fixing agent, and (iii) a hydrophilic binder having a swelling rate T ½ greater than 5 seconds.

31. The process of claim 30 wherein said bleach-fix sheet additionally contains a polymeric timing layer which temporarily delays operation of said bleaching and fixing agents.

32. The process of claim 30 wherein said bleach-fix sheet additionally contains a mordant for dyes.

33. A process of producing a retained image in a photographic film comprising:

(a) treating an imagewise-exposed element comprising a support having thereon at least one photosensitive silver halide emulsion layer having associated therewith a dye image-providing material with alkaline processing solution in the presence of a silver halide developing agent;

(b) imagewise removing dye image-providing material from the element by releasing said dye image-providing material in said processing composition, or by contacting said processed element with an image-receiving element and removing the image-receiving element; and (c) contacting the element with a bleach-fix sheet comprising:

(i) a metallic silver bleaching agent, (ii) a silver salt fixing agent, and (iii) a hydrophilic binder having a swelling rate T ½ greater than 5 seconds.

* * * * *

UNITED STATES PATENT AND TRADEMARK OFFICE

CERTIFICATE OF CORRECTION

PATENT NO. 4,256,826

DATED March 17, 1981

INVENTOR(S) Gerhard Popp, Patrick H. Saturno and Keith H. Stephen

It is certified that error appears in the above-identified patent and that said Letters Patent are hereby corrected as shown below:

Column 1, line 37, "used in" should read ---used is---.

Column 10, line 59, "bathochronically" should read ---bathochromically---.

Column 11, lines 23-24, "emusion" should read ---emulsion---.

Column 17, lines 46-48, that part of the formula reading

" $CH_3-\underset{\underset{CH_3}{|}}{\overset{|}{N}}-CH_3$ " should read --- $CH_3-\underset{\underset{CH_3^+}{|}}{\overset{|}{N}}-CH_3$ --- .

Column 18, line 43, after "and" delete ";b"; line 49, "reamined" should read ---remained---.

UNITED STATES PATENT AND TRADEMARK OFFICE

CERTIFICATE OF CORRECTION

PATENT NO. 4,256,826

DATED March 17, 1981

INVENTOR(S) Gerhard Popp, Patrick H. Saturno and Keith H. Stephen

It is certified that error appears in the above-identified patent and that said Letters Patent are hereby corrected as shown below:

Column 19, line 29, "hydrophiic" should read ---hydrophilic---.

Column 20, line 31, after "ballasted" insert ---redox magenta dye image-providing material associated---.

Column 21, lines 22-23, "electromagentic" should read ---electromagnetic---.

Signed and Sealed this

*Eighteenth* Day of *May 1982*

[SEAL]

*Attest:*

GERALD J. MOSSINGHOFF

*Attesting Officer*

*Commissioner of Patents and Trademarks*